United States Patent [19]

Krumreich

[11] 4,224,485

[45] Sep. 23, 1980

[54] TELEPHONE JACK

[75] Inventor: Charles L. Krumreich, Indianapolis, Ind.

[73] Assignee: Bell Telephone Laboratories, Incorporated, Murray Hill, N.J.

[21] Appl. No.: 951,561

[22] Filed: Oct. 16, 1978

Related U.S. Application Data

[63] Continuation of Ser. No. 765,845, Feb. 4, 1977, now Defensive Publication No. T961,003.

[51] Int. Cl.[3] ..... H01R 33/30

[52] U.S. Cl. ..... 200/51.1; 179/1 PC; 339/176 M; 339/221 M; 340/531; 340/546

[58] Field of Search ..... 200/51.1, 51.04, 51.09; 340/531, 546; 179/1 PC, 1 SW, 5 P, 5 R, 95–97; 339/176 M, 221 M, 19

[56] References Cited

U.S. PATENT DOCUMENTS

| | | | |
|---|---|---|---|
| 1,384,491 | 7/1921 | Simon | 200/51.11 |
| 1,793,846 | 2/1931 | Durbin | 200/51.1 |
| 2,909,615 | 10/1959 | Frantz | 200/51.1 X |
| 3,275,765 | 9/1966 | Ferdon et al. | 339/19 X |
| 3,418,438 | 12/1968 | Barrett | 200/51.1 |
| 3,710,024 | 1/1973 | Lacey | 179/5 P |
| 3,850,497 | 11/1974 | Krumreich et al. | 339/176 M X |

FOREIGN PATENT DOCUMENTS

| | | | |
|---|---|---|---|
| 553677 | 3/1958 | Canada | 200/51.11 |
| 1220920 | 7/1966 | Fed. Rep. of Germany | 200/51.1 |

*Primary Examiner*—Stephen Marcus
*Attorney, Agent, or Firm*—Harry L. Newman

[57] ABSTRACT

A jack in accordance with the present invention includes a plurality of contact springs that are arranged in a row side by side one another and extend rearwardly cantilever fashion within a plug-receiving cavity. It further includes a switch disposed on each side of the connector contacts. Each switch comprises a movable contact spring that is normally in engagement with a stationary contact spring. The movable contact springs extend within the plug-receiving cavity while the stationary contact springs are remote to the opening.

The jack is intended to be connected to a telephone line by respectively wiring the switches in series with the ring and tip conductors and wiring an individual connector contact in parallel with each of the switch contacts. Continuity in the telephone line is then provided by the closed switches of the jack when no plug is inserted into the jack. In addition, if a plug of a size not to engage the movable switch contacts is inserted into the jack and the contacts on the plug only engage one of the connector contacts wired to the tip conductor and one of the connector contacts wired to the ring conductor, line continuity continues and the station apparatus terminated by the plug is bridged across the telephone line.

But if a plug of a size to engage the movable switch contacts is inserted into the jack, the movable contacts are deflected from their associated stationary contacts to interrupt the continuity of the telephone line. Then by providing the plug with contacts that engage both connector contacts wired to the tip conductor and both connector contacts wired to the ring conductor, the station apparatus terminated by the plug is connected in series with the telephone line.

14 Claims, 5 Drawing Figures

TELEPHONE JACK

CROSS REFERENCE TO RELATED DEFENSIVE PUBLICATION

This application is a continuation of my application Ser. No. 765,845, filed Feb. 4, 1977, and now Defensive Publication T961,003, published Aug. 2, 1977.

TECHNICAL FIELD

This invention relates to the field of connectors and within that field to female connectors, commonly referred to as jacks, for making electrical connections with telephone equipment.

BACKGROUND OF THE INVENTION

Miniature jacks of the type disclosed in U.S. Pat. No. 3,850,497 issued to C. L. Krumreich, A. E. Mulbarger, Jr., and S. W. Walden on Nov. 26, 1974, are now coming into common use in the telephone industry for providing connections to one or more telephone lines, each line consisting of two conductors conventionally referred to as tip and ring. The jacks accommodate miniature plugs of the type disclosed in U.S. Pat. No. 3,761,869 issued to E. C. Hardesty, C. L. Krumreich, A. E. Mulbarger, Jr., and S. W. Walden on Sept. 25, 1973, which plugs are used to terminate station equipment such as telephone sets. In addition, the jacks are wired in parallel with the associated telephone lines, and this provides all station equipment connected to jacks wired to the same telephone line equal access to that line.

However, with some station equipment, such as automatic reporting telephones used in security systems, it is necessary for the telephone to be always able to seize the telephone line when an alarm condition occurs. Of course this can be accomplished by having just the alarm reporting telephone connected to a telephone line, but it is costly to dedicate a telephone line to this one use. A more practical solution is to connect the reporting telephone in series with the telephone line ahead of all other station equipment connected to that line. The reporting telephone is then designed to provide continuity to the telephone line, and it is able to disconnect the other station equipment when an alarm condition occurs. It is therefore assured of access to the telephone line at all times.

Since the previously referred to miniature jack has at least four contacts, it is certainly possible to connect it in series with a telephone line for use with such series station equipment. However, should the series station equipment be unplugged from such a series-wired jack, continuity in the telephone line would be broken and all other station equipment connected to the line would be disabled. Since it would not be obvious that the jack is wired differently, such inadvertent disruption of service would likely occur. Furthermore, inasmuch as the miniature plugs and jacks are being introduced to permit the installation and removal of station equipment by the subscribers themselves, it is undesirable to create a situation that requires a telephone installer to rewire a jack when the station equipment connected thereto is changed.

SUMMARY OF THE INVENTION

A jack in accordance with the present invention avoids these series jack problems in that it provides a series connection to a telephone line when a large size plug is mated therewith. In addition, it provides line continuity and a bridge connection to the telephone line when a lesser size plug is mated therewith and provides line continuity alone when no plug is mated therewith. The jack is similar to the prior miniature jack in that it includes a plurality of contact springs that are arranged in a row side by side one another and extend rearwardly cantilever fashion within a plug-receiving opening. It differs from this prior jack in that it further includes a switch disposed on each side of the connector contacts. Each switch comprises a movable contact spring that extends in juxtaposition with, is biased toward, and normally in engagement with a stationary contact spring. The movable contact springs extend within the plug-receiving opening while the stationary contact springs are remote to the opening.

The jack is connected to the telephone line by respectively wiring the switches in series with the ring and tip conductors and wiring an individual connector contact in parallel with each of the switch contacts. Thus one connector contact is wired to the incoming end of the tip conductor and a second connector contact is wired to the outgoing end of the tip conductor. Similarly, a third connector contact is wired to the incoming end of the ring conductor and a fourth connector contact is wired to the outgoing end of the ring conductor.

With this arrangement, when no plug is inserted into the jack, continuity in the telephone line is provided by the closed switches of the jack. In addition, if a plug of a size not to engage the movable switch contacts is inserted into the jack and the contacts on the plug only engage one of the connector contacts wired to the tip conductor and one of the connector contacts wired to the ring conductor, line continuity continues and the station apparatus terminated by the plug is bridged across the telephone line.

But if a plug of a size to engage the movable switch contacts is inserted into the jack, the movable contacts are deflected from their associated stationary contacts to interrupt the continuity of the telephone line. Then by providing the plug with contacts that engage both connector contacts wire to the tip conductor and both connector contacts wired to the ring conductor, the station apparatus terminated by the plug is connected in series with the telephone line.

DETAILED DESCRIPTION

Figure 1:
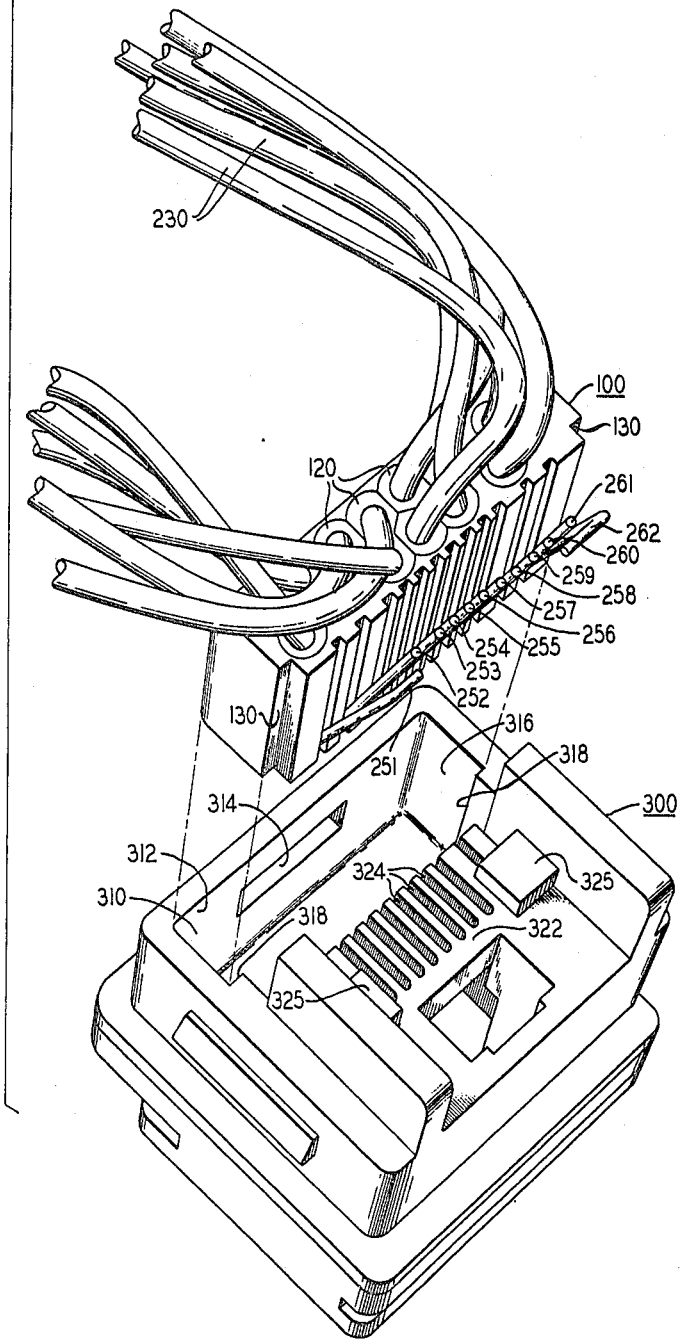
FIG. 1 is an exploded perspective view of a connector in accordance with the present invention.
Figure 3:
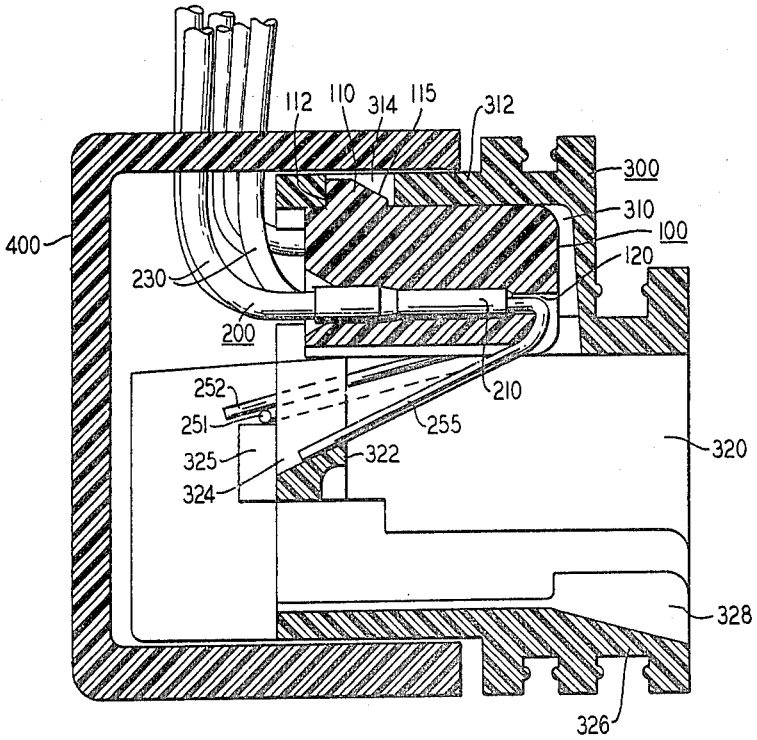
FIG. 3 is a sectional view taken along line 3—3 of FIG. 2.

Referring to FIG. 1 of the drawing, a jack in accordance with the present invention comprises a unitary dielectric contact carrier 100 mounted within a unitary dielectric support 300. The contact carrier 100 is similar to the contact carrier disclosed in my U.S. Pat. No. 3,990,764 issued on Nov. 9, 1976 in that it has a generally rectangular box-like shape and, as shown in FIG. 3, includes a latch 110 upstanding from the top thereof. The latch 110 has a wedge-shaped profile and includes a trailing blocking surface 112 that extends perpendicular to the top of the carrier 100 and a leading cam surface 115 that is inclined to the top of the carrier and the blocking surface.

Referring to both FIGS. 1 and 3, the carrier 100 has twelve staggered orifices 120 extending therethrough from the front to the rear thereof within which individual contact assemblies 200 are respectively accommodated. The orifices 120 and contact assemblies 200 are basically the same as that disclosed in the Krumreich et al. patent and therefore need not be described in detail here. Suffice it to say that each contact assembly 200 includes a conductive splicing member 210 that clamps the bared end of an insulated lead wires 230 to an end of a wire contact spring. The contact springs, which are numbered 251–262, extend out the front of the orifices 120 and are formed to extend rearwardly cantilever fashion beneath the bottom of the carrier 100. The outer most contact springs 251 and 262 are provided with an L-shaped configuration, and the laterally extending legs thereof respectively underlie the adjacent contact springs 252 and 261.

The contact carrier 100 is accommodated by a carrier-receiving cavity 310 in the upper rear of the support 300. Upper wall 312 of the cavity 310 has an opening 314 therein of a size to accommodate the latch 110 of the carrier 100, while side walls 316 of the cavity include ledges 318 adapted to engage relieved side edges 130 on the underside of the carrier. The spacing between the facing surfaces of the upper wall 312 and the side ledges 318 is such that when the carrier 100 is initially inserted into the cavity 310, the upper wall is deflected upward by the cam surface 115 of the latch 110. Then when the carrier 100 is moved to a position where the latch 110 is in registration with the opening 314, the upper wall returns to its undeflected position. The latch 110 then extends within the opening 314, and the blocking surface 112 of the latch cooperates with the rear surface of the opening to prevent the removal of the carrier 100 from the cavity 310. Once the carrier 100 is in place, a dust cover 400 is advantageously mounted over the back end of the support 300.

The support 300 also includes a plug-receiving cavity 320 that is open to the front of the support and is situated beneath the carrier receiving cavity 310. The two cavities are in full communication with one another in that no partition separates the bottom of the carrier-receiving cavity 310 from the top of the plug-receiving cavity 320. The rear of the plug-receiving cavity 320 is defined by a wall 322 situated beneath the entrance to the carrier-receiving cavity 310, and the wall has twelve slots 324 therein, the upper ends of which are open. The slots 324 are somewhat wider that the diameter of the contact springs 251–262 and are spaced the same distance apart as the contact springs. The middle eight slots 324 are of uniform depth, while the pair of slots to each side thereof are of more shallow depth. In addition, bosses 325 protruding from the back surface of the rear wall 322 include horizontal surfaces that respectively underlie each of these outer pairs of slots 324.

Figure 4:
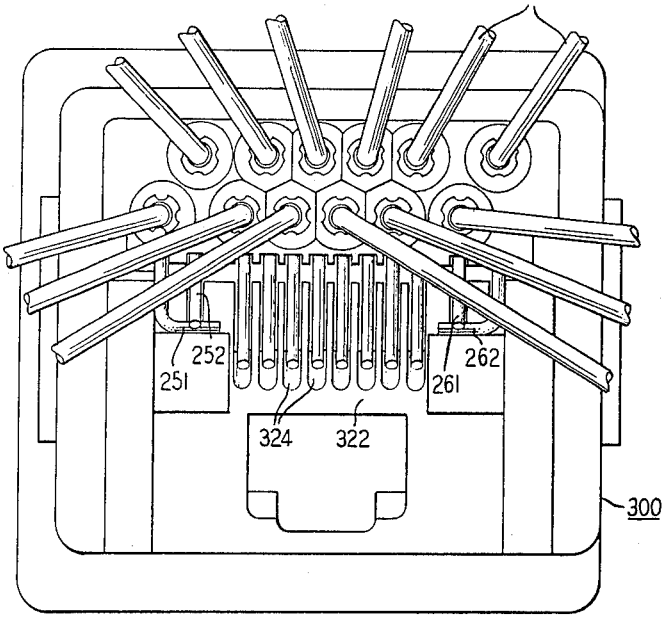
FIG. 4 is a rear view of the connector with no plug inserted.

Thus, when the contact carrier 100 is inserted within the carrier-receiving cavity 310, the cantilever portions of the contact springs 251–262 move into the slots 324. Furthermore, as shown in FIG. 4, when the contact carrier 100 is fully positioned within the carrier-receiving cavity 310, the free ends of the middle eight contact springs 253–260 are situated within the slots 324. However, the free ends of the L-shaped contact springs 251 and 262, that is, the transverse legs thereof, rest on the horizontal surfaces of the bosses 325, and the free ends of the contact springs 252 and 261 respectively rest on the transverse legs. As a result, a pair of normally closed switches, consisting of contact pairs 251–252 and 261–262, are provided, and the location of the horizontal surfaces of the bosses 325 is such as that the contact springs 252 and 261 are sufficiently deflected to provide the desired contact force.

Figure 2:
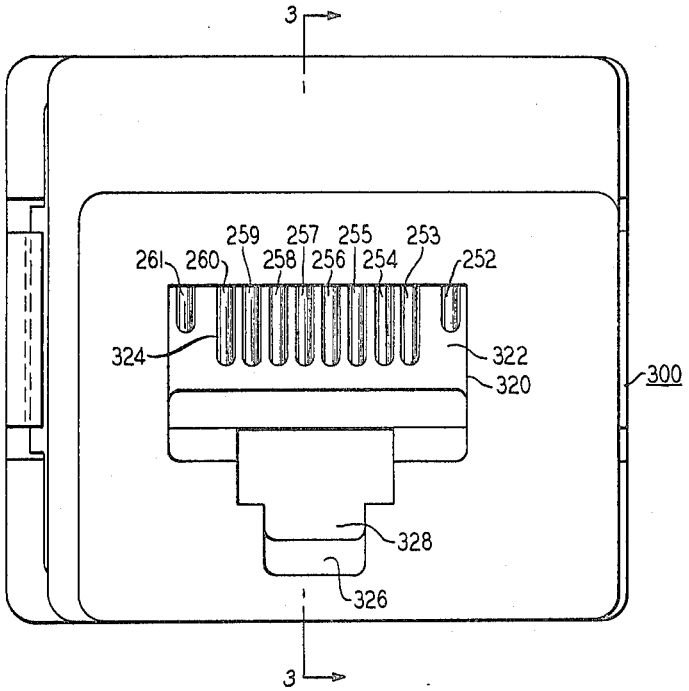
FIG. 2 is a front view of the connector.

As shown in FIG. 2, only the ten middle slots 324 are situated within the plug-receiving cavity 320, the outer most slots being outside of the cavity. Consequently, only the cantilever portions of the contact springs 252–261 extend within the plug-receiving cavity 320, the L-shaped contact springs 251 and 262 being remote to the cavity.

The cavity 320 is adapted to accommodate a plug of the type disclosed in the aforementioned Hardesty et al. patent, and as shown in FIGS. 2 and 3, bottom wall 326 of the cavity includes a keyway 328 that is centered between the side walls of the cavity and cooperates with the latch of the plug to properly locate the plug within the cavity. With the plug being keyed to the center rather than the sides of the cavity 320, the jack is adapted to mate with plugs of different widths and with different numbers of contacts.

Figure 5:
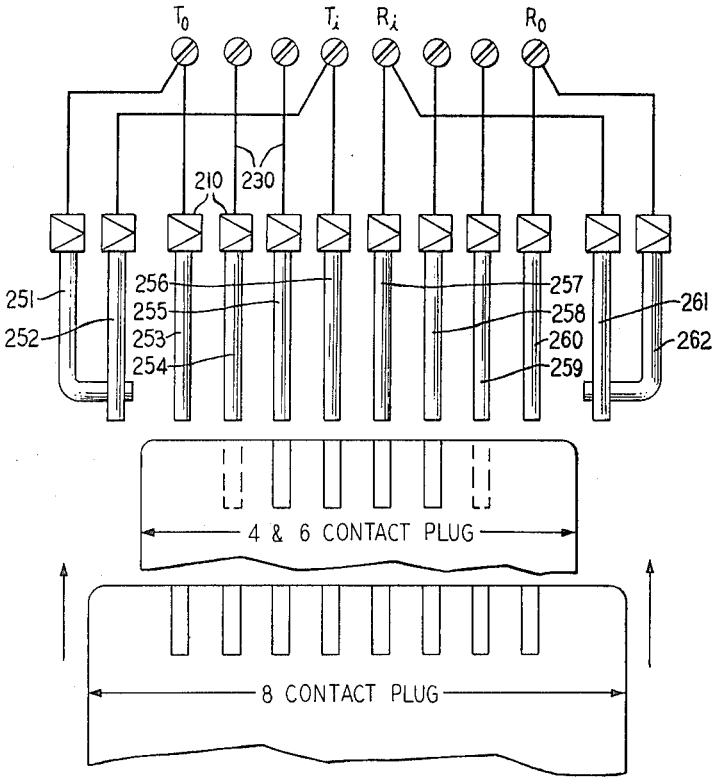
FIG. 5 is a schematic representation of the connector and mating plugs.

Referring to FIG. 5 wherein the jack and mating plugs are depicted schematically, it is seen that the jack accommodates four, six, and eight contact plugs. The four and six contact plugs are advantageously the same width, the four contact plug making electrical connection with contact springs 255–258 of the jack and the six contact plug making electrical connection with contact springs 254–259 of the jack. The housing of this size plug engages the contact springs 253 and 260, but since the housing is nonconducting, no electrical connection is made. On the other hand, the housing of this size plug does not engage the contact springs 252 and 261, and consequently, the switches provided by the contact pairs 251–252 and 261–262 remain closed.

However, when an eight contact plug is inserted into the plug-receiving cavity 320, it makes electrical connection with contact springs 253–260 of the jack. In addition, the housing of the eight contact plug is of a size to engage the contact springs 252 and 261 and respectively deflect them upwardly away from the transverse legs of the contact springs 251 and 262 which remain stationary. Consequently, the switches provided by the contact pairs 251–252 and 261–262 are both opened. No electrical connection is made with the contact springs 252–261 because of the housing being nonconductive.

As schematically depicted in FIG. 5, when the jack of this invention is employed to connect station equipment to a telephone line, contact springs 252 and 256 are connected to the incoming end of the tip conductor and contact springs 251 and 253 are connected to the outgoing end of the tip conductor. Similarly, contact springs 261 and 257 are connected to the incoming end of the ring conductor and contact springs 262 and 260 are connected to the outgoing end of the ring conductor. The remaining contact springs 255 and 258, which are engaged by a four contact plug, and 254 and 259, which are engaged by a six contact plug, may be used to provide power for auxiliary services, such as dial illumination, or A-lead control for key telephone systems.

With the foregoing connections, switch contacts 251 and 252 are connected in series with the tip conductor and switch contacts 261 and 262 are connected in series with the ring conductor. Thus when no plug is present in the jack, the closed switches provide line continuity. When a four or six contact plug is inserted into the jack, the switches remain closed so that line continuity remains and a bridged connection to the telephone line is provided via contact springs 256 and 257. Finally, when an eight contact plug is inserted, the switches are opened to interrupt line continuity and a series connection is provided via the pair of contact springs 253 and 256 and the pair of contact springs 257 and 260.

I claim:

1. A telephone jack for selectively connecting and disconnecting telephone station equipment to a telephone line, the station equipment being connected to the jack by plugs complementary to the jack, the jack comprising:

a housing including a cavity for accommodating complementary plugs of different sizes;

a plurality of connector contact springs positioned within the cavity for engaging the contacts of the complementary plugs; and a pair of switch contact springs, one of which is biased against the other contact spring, the biased contact spring being deflected away from the other contact spring responsive to the insertion within the cavity of a complementary plug of a first size, and the biased contact spring remaining in engagement with the other contact spring upon the insertion in the opening of a complementary plug of a second size, the switch contact springs being respectively electrically connected in parallel with individual connector contact springs.

2. A jack as in claim 1 wherein the biased switch contact spring is situated within the cavity of the housing while the other switch contact spring is remote to the cavity.

3. A jack as in claim 2 wherein the switch contact springs comprise a straight wire spring contact that overlies, is biased toward, and is normally in engagement with the laterally extending leg of an L-shaped wire spring contact.

4. A jack as in claim 1 further including a second pair of switch contact springs, one of which is biased against the other contact spring, and is deflected away from the other contact spring responsive to the insertion within the cavity of a complementary plug of a first size and remains in engagement with the other contact spring upon the insertion within the cavity of a complementary plug of a second size.

5. A jack as in claim 4 wherein the switch contact springs straddle the connector contact springs, the biased contact spring of each pair of switch contact springs being located adjacent to a side of the cavity and the other contact spring of each pair of switch contact springs being located remote to the cavity.

6. A jack as in claim 5 wherein the housing includes keying means that serve to locate the complementary plug with respect to the center of the cavity.

7. A jack as in claim 4 wherein one pair of switch contact springs is connected in series with a tip conductor of the telephone line and the other pair of switch contact springs is connected in series with a ring conductor of the telephone line and an individual connector contact spring is connected in parallel with each switch contact spring.

8. A jack as in claim 7 wherein individual connector contact springs immediately adjacent to the biased switch contact springs are respectively connected in parallel with one switch contact spring of each switch and a center pair of connector contact springs are respectively connected in parallel with the other contact spring of each switch.

9. A telephone jack comprising:

a housing including a cavity for accommodating complementary plugs of different widths, the rear of the cavity including contact support means;

a plurality of connector contact springs for engaging the contacts of a complementary plug positioned within the cavity, the connector contact springs being arranged in a row and extending rearwardly cantilever fashion within the cavity; and two pairs of switch contact springs straddling the connector contact springs and also extending rearwardly cantilever fashion, the free end of a first contact spring of each pair resting on the support means of the housing and the free end of the second contact spring of each pair overlying the associated first contact spring, the support means locating the free ends of the first contact springs in a position wherein they and the second contact springs are deflected upward from the position they would naturally occupy whereby the second contact springs are biased against the associated first contact springs with a particular contact force, the first contact springs being to the outside of the second contact springs and the insertion of a complementary plug of a width to engage the second contact springs deflecting the second contact springs from the first contact springs and the insertion of a complementary plug of a lesser width resulting in the second contact springs remaining in engagement with the first contact springs.

10. A jack as in claim 9 wherein each first contact spring of the switch contact springs comprises an L-shaped wire spring contact having a laterally extending leg at the free end thereof that rests on the support means and each second contact spring of the switch contact springs comprises a straight wire spring contact that overlies the laterally extending leg of the associated first contact spring.

11. A jack as in claim 10 wherein the support means comprises a wall at the rear of the cavity having slots within which the first and second contact springs are accommodated and having a surface behind the slots that underlies the laterally extending leg of each first contact spring.

12. A telephone jack for selectively connecting and disconnecting telephone station equipment to a telephone line, the station equipment being connected to the jack by plugs complementary to the jack, the jack accommodating complementary plugs of different sizes and including switch means connected in series with the telephone line and plug contact engaging contacts connected in parallel with the switch means, the jack providing continuity in the telephone line when no plug is inserted therein, continuity in the telephone line and a bridged connection to the telephone line when a plug of a first size is inserted into the jack, and interruption in the continuity of the telephone line and series connection to the telephone line when a plug of a second size is inserted into the jack.

13. A jack as in claim 12 wherein the switch means comprises two switches, each including a pair of contacts, the contacts of the first switch being connected in series with a tip conductor of the telephone line and the contacts of the second switch being connected in series with a ring conductor of the telephone line, and an individual plug contact engaging contact being connected in parallel with each switch contact.

14. A jack as in claim 13 further including a housing having a cavity within which the complementary plugs are accommodated, the plug contacts engaging contacts being positioned within the cavity and one contact of each pair of switch contacts being positioned within the cavity while the other contact of each pair is positioned remote to the cavity.

* * * * *